US009771250B2

(12) United States Patent
Ueda et al.

(10) Patent No.: US 9,771,250 B2
(45) Date of Patent: Sep. 26, 2017

(54) HYDRAULIC CONTROL DEVICE FOR FORKLIFT

(71) Applicants: KABUSHIKI KAISHA TOYOTA JIDOSHOKKI, Kariya-shi, Aichi-ken (JP); NISHINA INDUSTRIAL CO., LTD., Nagano-shi, Nagano-ken (JP)

(72) Inventors: Yuki Ueda, Kariya (JP); Tsutomu Matsuo, Kariya (JP); Hirohiko Ishikawa, Kariya (JP); Tetsuya Goto, Kariya (JP); Junichi Morita, Kariya (JP); Toshinari Fukatsu, Kariya (JP); Akira Nakajo, Nagano (JP); Ryo Yazawa, Nagano (JP)

(73) Assignees: KABUSHIKI KAISHA TOYOTA JIDOSHOKKI, Kariya-shi, Aichi-ken (JP); NISHINA INDUSTRIAL CO., LTD., Nagano-shi, Nagano-ken (JP)

( * ) Notice: Subject to any disclaimer, the term of this patent is extended or adjusted under 35 U.S.C. 154(b) by 497 days.

(21) Appl. No.: 14/368,410

(22) PCT Filed: Dec. 10, 2012

(86) PCT No.: PCT/JP2012/081965
§ 371 (c)(1),
(2) Date: Jun. 24, 2014

(87) PCT Pub. No.: WO2013/099575
PCT Pub. Date: Jul. 4, 2013

(65) Prior Publication Data

US 2014/0331662 A1 Nov. 13, 2014

(30) Foreign Application Priority Data

Dec. 26, 2011 (JP) ..... 2011-284271

(51) Int. Cl.
*B66F 9/22* (2006.01)
*F15B 11/044* (2006.01)
(Continued)

(52) U.S. Cl.
CPC ..... *B66F 9/22* (2013.01); *E02F 9/2246* (2013.01); *F15B 11/044* (2013.01);
(Continued)

(58) Field of Classification Search
CPC ..... F04B 2201/1202; F04B 2201/1203; F15B 2011/0246
See application file for complete search history.

(56) References Cited

U.S. PATENT DOCUMENTS 4,573,319 A 3/1986 Chichester
4,723,107 A * 2/1988 Schmid ..... F15B 21/14 318/139
(Continued)

FOREIGN PATENT DOCUMENTS

DE GB 2360757 A * 10/2001 ..... B66F 9/22
EP 1046610 A2 10/2000
(Continued)

OTHER PUBLICATIONS

International Preliminary Report on Patentability dated Jul. 1, 2014, from the International Bureau of WIPO in counterpart International Application No. PCT/JP2012/081965.
(Continued)

*Primary Examiner* — Thomas E Lazo
*Assistant Examiner* — Matthew Wiblin
(74) *Attorney, Agent, or Firm* — Sughrue Mion, PLLC

(57) ABSTRACT

A hydraulic control device for a forklift includes a hydraulic pump, a single electric motor for driving the hydraulic pump, an outflow control mechanism provided between a lift cylinder and the hydraulic pump, a flow control valve
(Continued)

provided between the outflow control mechanism and a draining portion, and a controller. When a lowering operation of a fork and either forward or rearward mast tilting operations of a mast are performed at the same time, the controller controls the electric motor based on a target speed of the hydraulic pump. The flow control valve controls the flow rate of hydraulic fluid from the lift cylinder to the hydraulic pump and the flow rate from the lift cylinder to the draining portion in accordance with the difference between the actual rotation speed of the hydraulic pump and the target rotation speed of the hydraulic pump.

7 Claims, 8 Drawing Sheets

(51) Int. Cl.
*E02F 9/22* (2006.01)
*F15B 11/042* (2006.01)

(52) U.S. Cl.
CPC . *F15B 11/0423* (2013.01); *F15B 2211/20515* (2013.01); *F15B 2211/20561* (2013.01); *F15B 2211/40515* (2013.01); *F15B 2211/41581* (2013.01); *F15B 2211/428* (2013.01); *F15B 2211/45* (2013.01); *F15B 2211/7052* (2013.01); *F15B 2211/761* (2013.01)

(56) References Cited

U.S. PATENT DOCUMENTS

| | | | | | |
|---|---|---|---|---|---|
| 5,505,043 | A * | 4/1996 | Baginski | ..... | B66F 9/20 60/477 |
| 2010/0021313 | A1* | 1/2010 | Devan | ..... | F04B 17/03 417/44.1 |
| 2013/0199170 | A1* | 8/2013 | Neumann | ..... | B66F 9/22 60/384 |

FOREIGN PATENT DOCUMENTS

| | | | | | |
|---|---|---|---|---|---|
| JP | 02-15999 | U | | 2/1990 | |
| JP | 02-163300 | A | | 6/1990 | |
| JP | 02163300 | A | * | 6/1990 | ..... F15B 11/00 |
| JP | 02-231398 | A | | 9/1990 | |
| JP | 02-305800 | A | | 12/1990 | |
| JP | 09-002301 | A | | 1/1997 | |

OTHER PUBLICATIONS

Communication dated Aug. 6, 2015 from the European Patent Office in counterpart application No. 12861214.0.

* cited by examiner

HYDRAULIC CONTROL DEVICE FOR FORKLIFT

CROSS REFERENCE TO RELATED APPLICATIONS

This is a National Stage of International Application No. PCT/JP2012/081965 filed Dec. 10, 2012, claiming priority based on Japanese Patent Application No. 2011-284271 filed Dec. 26, 2011, the contents of all of which are incorporated herein by reference in their entirety.

FIELD OF THE INVENTION

The present invention relates to a hydraulic control device for a forklift, and, more particularly, to a hydraulic control device that controls a lift cylinder and a tilt cylinder.

BACKGROUND OF THE INVENTION

Conventionally, a forklift employs a hydraulic cylinder as a mechanism for operating movable members such as a fork or a mast. For example, a hydraulic device described in Patent Document 1 includes a single hydraulic pump and a single electric motor for operating the hydraulic pump. The hydraulic device drives the hydraulic pump to operate a hydraulic cylinder (a lift cylinder) for selectively raising and lowering a fork and a hydraulic cylinder (a tilt cylinder) for tilting a mast.

PRIOR ART DOCUMENTS

Patent Documents

Patent Document 1: Japanese Laid-Open Patent Publication No. 2-231398

SUMMARY OF THE INVENTION

To raise/lower the fork or tilt the mast independently from each other, the hydraulic device having the single hydraulic pump controls the electric motor in accordance with a speed instructed to operate the fork or the mast such that the fork or the mast is operated at the instructed speed. However, to raise/lower the fork and tilt the mast simultaneously, the hydraulic device must control the electric motor in accordance with only one of the speed instructed to operate the fork and the speed instructed to operate the mast. This makes it difficult to operate the fork and the mast at the respective instructed speeds by means of the hydraulic device.

Accordingly, it is an objective of the present invention to provide a hydraulic control device for a forklift capable of operating a fork and a mast simultaneously both in a favorable manner.

To achieve the foregoing objective and in accordance with a first aspect of the present invention, a hydraulic control device for a forklift is provided, in which the hydraulic control device selectively raises and lowers a fork by supplying hydraulic fluid to a lift cylinder or discharging hydraulic fluid from the lift cylinder through manipulation of a raising/lowering instruction member, and the hydraulic control device tilts a mast to which the fork is attached selectively forward and rearward by supplying hydraulic fluid to a tilt cylinder and/or discharging hydraulic fluid from the tilt cylinder through manipulation of a tilting instruction member. The hydraulic control device includes at least one hydraulic pump, a single electric motor for driving the hydraulic pump, an outflow control mechanism, a flow control valve, and a controller. The outflow control mechanism is arranged between the lift cylinder and the hydraulic pump. The outflow control mechanism permits hydraulic fluid to flow from a bottom chamber of the lift cylinder to the hydraulic pump when the fork is lowered, and the outflow control mechanism prohibits hydraulic fluid from flowing from the bottom chamber of the lift cylinder to the hydraulic pump when the fork is in a stopped or raised state. The flow control valve is arranged between the outflow control mechanism and a draining portion. The controller controls the electric motor. When the fork is lowered and, simultaneously, the mast is tilted forward or rearward, the controller controls the electric motor based on a target rotation speed of the hydraulic pump necessary for operation at an instructed speed corresponding to a manipulation amount of the raising/lowering instruction member or a manipulation amount of the tilting instruction member. The flow control valve controls a flow rate of hydraulic fluid flowing from the lift cylinder to the hydraulic pump and a flow rate of the hydraulic fluid flowing from the lift cylinder to the draining portion in correspondence with a difference between an actual rotation speed of the hydraulic pump and the target rotation speed of the hydraulic pump necessary to lower the fork at the instructed speed corresponding to the manipulation amount of the raising/lowering instruction member.

In this configuration, when the fork and the mast are operated simultaneously with a difference between the actual rotation speed and the target rotation speed of the hydraulic pump, the flow control valve operates to deliver hydraulic fluid from the lift cylinder to the draining portion by a flow rate corresponding to the difference between the target rotation speed and the actual rotation speed. In other words, the flow control valve delivers the hydraulic fluid from the lift cylinder to the draining portion by such a flow rate that corresponds to the shortage in the flow rate necessary for operation at the instructed speed. As a result, when the fork and the mast are operated simultaneously, the fork and the mast are operated both in a favorable manner.

In accordance with a second aspect of the present invention, a hydraulic control device for a forklift is provided in which the hydraulic control device selectively raises and lowers a fork by supplying hydraulic fluid to a lift cylinder or discharging hydraulic fluid from the lift cylinder through manipulation of a raising/lowering instruction member, and the hydraulic control device tilts a mast to which the fork is attached selectively forward and rearward by supplying hydraulic fluid to a tilt cylinder and/or discharging hydraulic fluid from the tilt cylinder through manipulation of a tilting instruction member. The hydraulic control device includes a single hydraulic pump, a single electric motor for driving the hydraulic pump, an outflow control mechanism, a flow control valve, and a controller. The outflow control mechanism is arranged between the lift cylinder and the hydraulic pump. The outflow control mechanism permits hydraulic fluid to flow from a bottom chamber of the lift cylinder to the hydraulic pump when the fork is lowered, the outflow control mechanism prohibits hydraulic fluid from flowing from the bottom chamber of the lift cylinder to the hydraulic pump when the fork is in a stopped or raised state. The flow control valve is arranged between the hydraulic pump and the outflow control mechanism. The controller controls the electric motor. The controller controls the electric motor when performing at least one of fork raising/lowering based on the manipulation of the raising/lowering instruction member and forward or rearward mast tilting based on the manipulation of the tilting instruction member. When performing the lowering of the fork, the flow control valve controls a flow rate of the hydraulic fluid flowing from the lift cylinder to the hydraulic pump and a flow rate of the hydraulic fluid flowing from the lift cylinder to a draining portion in correspondence with a difference between a target rotation speed of the hydraulic pump necessary to lower the fork at an instructed speed corresponding to a manipulation amount of the raising/lowering instruction member and an actual rotation speed of the hydraulic pump.

DETAILED DESCRIPTION OF THE PREFERRED EMBODIMENTS

First Embodiment

A hydraulic control device for a forklift according to a first embodiment of the present invention will now be described with reference to FIGS. 1 to 4.

Figure 2:
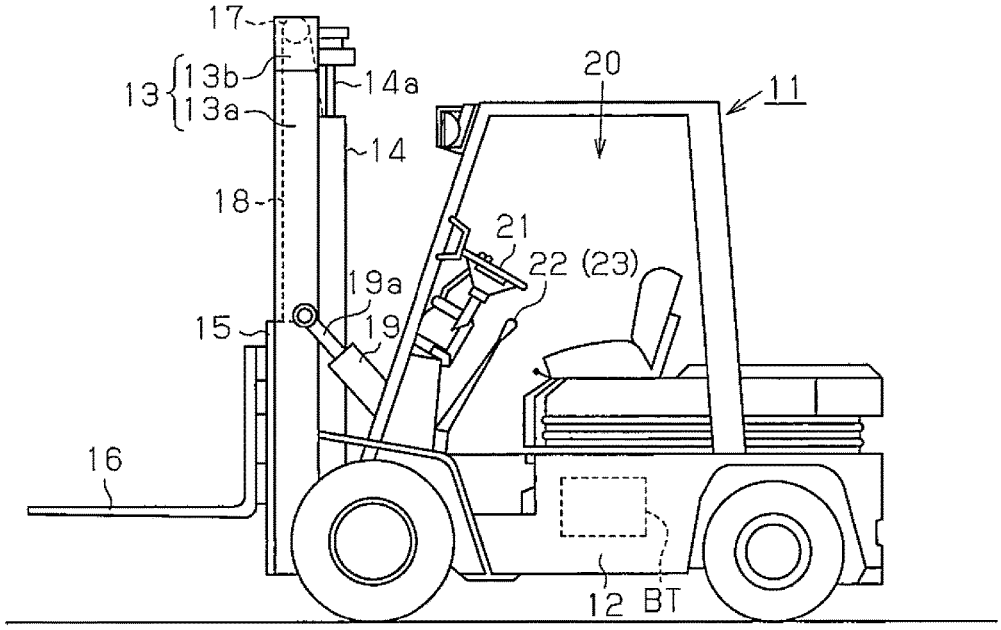
FIG. 2 is a side view showing a forklift.

As shown in FIG. 2, a mast 13 is mounted in a front portion of a body frame 12 of a battery type forklift 11. The mast 13 includes a pair of, left and right, outer mast portions 13*a* and a pair of, left and right, inner mast portions 13*b*. The outer mast portions 13*a* are each supported to the body frame 12 in a tiltable manner. The inner mast portions 13*b* are arranged on the inner sides of the outer mast portions 13*a* each in a movable manner in an upward-downward direction. A lift cylinder 14 serving as a hydraulic cylinder for loading is fixed to the rear side of each outer mast portion 13*a* and extends parallel to the outer mast portion 13*a*. The distal end of a piston rod 14*a* of the lift cylinder 14 is connected to an upper portion of the corresponding inner mast portion 13*b*.

A lift bracket 15 is mounted on the inner side of the inner mast portions 13*b* and allowed to ascend or descend along the inner mast portions 13*b*. A fork 16 is attached to the lift bracket 15. A chain wheel 17 is supported to the upper portion of each inner mast portion 13*b*. A chain 18 is wound around the chain wheel 17 and has a first end connected to an upper portion of the lift cylinder 14 and a second end connected to the lift bracket 15. The lift cylinders 14 are extended or retracted to raise or lower the fork 16 through the chains 18 together with the lift bracket 15.

A basal end of a tilt cylinder 19 serving as a hydraulic cylinder for loading is pivotally supported to the body frame 12 on each of the left and right sides. The distal end of a piston rod 19*a* of each tilt cylinder 19 is pivotally connected to a substantially middle portion of the corresponding outer mast portion 13*a* in the vertical direction. The mast 13 is tilted by extending or retracting the tilt cylinders 19.

A steering wheel 21, a lift lever 22 serving as a raising/lowering instruction member, and a tilt lever 23 serving as a tilting instruction member are arranged in a front portion of a cab 20. In FIG. 2, the lift lever 22 and the tilt lever 23 are illustrated in an overlapped state. The lift lever 22 is manipulated to selectively extend and retract the lift cylinders 14 to raise or lower the fork 16. The tilt lever 23 is manipulated to selectively extend and retract the tilt cylinders 19 to tilt the mast 13.

The mast 13 is tiltable in a range from a predetermined rearmost tilt position to a predetermined foremost tilt position. When the position of the mast 13 illustrated in FIG. 2 is defined as a upright position, tilting toward the cab 20 corresponds to the rearward tilting and tilting away from the cab 20 corresponds to the forward tilting. In the forklift 11 of the first embodiment, the mast 13 tilts forward when the tilt cylinders 19 are extended and rearward when the tilt cylinders 19 are retracted.

The hydraulic control device according to the first embodiment will hereafter be described with reference to FIG. 1.

The hydraulic control device controls operation of the lift cylinder 14 and operation of the tilt cylinder 19. With reference to FIG. 1, in the hydraulic control device of the first embodiment, a single pump and a single motor for driving the pump configure a mechanism (a hydraulic circuit) for operating the lift cylinder 14 and the tilt cylinder 19.

A pipe K1 serving as a fluid passage connected to a bottom chamber 14*b* of the lift cylinder 14 is connected to a hydraulic pump/motor 30 functioning as both a hydraulic pump and a hydraulic motor. A motor (a rotating electric machine) 31 functioning as an electric motor and a power generator is connected to the hydraulic pump/motor 30. In the first embodiment, the motor 31 functions as an electric motor when the hydraulic pump/motor 30 operates as a hydraulic pump. The motor 31 functions as a power generator when the hydraulic pump/motor 30 operates as a hydraulic motor. The hydraulic pump/motor 30 of the first embodiment is rotational in one direction.

A lift lowering proportional valve 32 serving as an electromagnetic proportional valve is arranged between the lift cylinder 14 and the hydraulic pump/motor 30. The lift lowering proportional valve 32 is switchable between a first position 32*a* and a second position 32*b*. When at the first position 32*a*, the lift lowering proportional valve 32 is in an open state and thus allows the hydraulic fluid delivered from the bottom chamber 14*b* for lift lowering to flow to the hydraulic pump/motor 30. In this state, the opening degree of the lift lowering proportional valve 32 is adjusted as needed. When at the second position 32*b*, the lift lowering proportional valve 32 is in a closed state and thus prohibits the hydraulic fluid from flowing. In the first embodiment, the lift lowering proportional valve 32 configures an outflow control mechanism. The outflow control mechanism permits hydraulic fluid to flow from the bottom chamber 14*b* of the lift cylinder 14 to the hydraulic pump/motor 30 when arranged at the first position 32*a* and prohibits the hydraulic fluid flow from the bottom chamber 14*b* to the hydraulic pump/motor 30 when located at the second position 32*b*. A fluid tank T is connected to an inlet port 30*a* of the hydraulic pump/motor 30 through a check valve 33 to retain the hydraulic fluid. The check valve 33 permits flow of the hydraulic fluid delivered from the fluid tank T. In contrast, the check valve 33 prohibits flow of the hydraulic fluid in the opposite direction to the direction away from the fluid tank T.

A pipe K2 serving as a bypass passage branched from the pipe K1 and connected to the fluid tank T is connected to a fluid outlet side of the lift lowering proportional valve 32. A flow control valve 34 that controls the flow rate of the hydraulic fluid in the pipe K2 is arranged in the pipe K2. In the first embodiment, the flow control valve 34 is mounted between the lift lowering proportional valve 32 and the bypass passage (the pipe K2), which is connected to the fluid outlet side of the flow control valve 34. The flow control valve 34 is switchable between a first position 34*a* as a fully closed state, a second position 34*b* as a fully open state, and a third position 34*c* as an adjustable open state where the opening degree is adjustable. In the first embodiment, the flow control valve 34 operates to be at any one of the first position 34*a*, the second position 34*b*, and the third position 34*c* in accordance with the difference between pressure P1 in the zone between the lift cylinder 14 and the lift lowering proportional valve 32 and pressure P2 in the zone between the lift lowering proportional valve 32 and the hydraulic pump/motor 30.

Specifically, the flow control valve 34 operates to decrease its opening degree as the difference between the pressure P1 and the pressure P2 increases and to increase the opening degree as the aforementioned pressure difference decreases. As a result, if the flow control valve 34 is at the first position 34*a*, the hydraulic fluid discharged from the bottom chamber 14*b* of the lift cylinder 14 flows to the inlet port 30*a* of the hydraulic pump/motor 30 via the lift lowering proportional valve 32. In other words, the full amount of the hydraulic fluid passing through the lift lowering proportional valve 32 is delivered to the inlet port 30*a* of the hydraulic pump/motor 30 as a flow rate Q1 represented in FIG. 1. In contrast, if the flow control valve 34 is at either the second position 34*b* or the third position 34*c*, the hydraulic fluid discharged from the bottom chamber 14*b* of the lift cylinder 14 flows to the inlet port 30*a* of the hydraulic pump/motor 30 and the fluid tank T through the lift lowering proportional valve 32. In other words, out of the total amount of the hydraulic fluid passing through the lift lowering proportional valve 32, the hydraulic fluid flows to the inlet port 30*a* of the hydraulic pump/motor 30 by the flow rate Q1 represented in FIG. 1 and to the fluid tank T by a flow rate Q2 represented in FIG. 1. The flow control valve 34 is adjusted in advance to open by an opening degree desired in correspondence with the aforementioned pressure difference.

A lift raising proportional valve 35 and a check valve 36 are connected to the pipe K1 on the side corresponding to an outlet port 30*b* of the hydraulic pump/motor 30. The lift raising proportional valve 35 is switchable between a first position 35*a* and a second position 35*b*. When at the first position 35*a*, the lift raising proportional valve 35 is in an open state and thus allows the hydraulic fluid delivered from the hydraulic pump/motor 30 to flow to the bottom chamber 14*b*. In this state, the opening degree of the lift raising proportional valve 35 is adjusted as needed. When at the second position 35*b*, the lift raising proportional valve 35 is in a closed state and thus causes the aforementioned hydraulic fluid to a tilting proportional valve 37 connected to a pipe K3 serving as a fluid passage. The check valve 36 permits the hydraulic fluid delivered from the lift raising proportional valve 35 to flow to the bottom chamber 14*b* of the lift cylinder 14. Meanwhile, the check valve 36 prohibits hydraulic fluid flow in the opposite direction to the direction toward the bottom chamber 14*b*.

A pipe K4 serving as a fluid passage connected to the fluid tank T via a filter 38 and a pipe K5 serving as a fluid passage connected to the tilting proportional valve 37 are arranged in a branched manner and connected to the pipe K1 on the side corresponding to the outlet port 30*b* of the hydraulic pump/motor 30. A relief valve 39 for preventing a fluid pressure rise is connected to the pipe K4. A pipe K6 serving as a fluid passage through which hydraulic fluid flows from the tilting proportional valve 37 to the fluid tank T is connected to the pipe K4. A check valve 40 is connected to the pipe K5 to permit hydraulic fluid to flow from the hydraulic pump/motor 30 but prohibit the hydraulic fluid from flowing toward the hydraulic pump/motor 30.

The tilting proportional valve 37 is switchable to any one of a first position 37*a* as a closed state, a second position 37*b* as an adjustable open state where the opening degree is adjustable, and a third position 37*c* as an adjustable open state where the opening degree is adjustable. When at the first position 37*a*, the tilting proportional valve 37 permits hydraulic fluid to flow from the lift raising proportional valve 35 to the fluid tank T. In the first embodiment, the first position 37*a* is the neutral position of the tilting proportional valve 37. The tilting proportional valve 37 is controlled by a controller S to operate toward either one of the second position 37*b* and the third position 37*c*. When at the second position 37*b*, the tilting proportional valve 37 permits the hydraulic fluid delivered from the check valve 40 to flow to a pipe K7 serving as a fluid passage connected to a rod chamber 19*r* of the tilt cylinder 19. Also, in this state, the tilting proportional valve 37 permits the hydraulic fluid flowing from a pipe K8 serving as a fluid passage connected to a bottom chamber 19*b* of the tilt cylinder 19 to flow to the pipe K6. When at the third position 37*c*, the tilting proportional valve 37 permits the hydraulic fluid delivered from the check valve 40 to flow to the pipe K8 and the hydraulic fluid delivered from the pipe K7 to flow to the pipe K6.

The configuration of the controller S of the hydraulic control device will now be described.

A potentiometer 22*a* for detecting the manipulation amount of the lift lever 22 and a potentiometer 23*a* for detecting the manipulation amount of the tilt lever 23 are electrically connected to the controller S. Using a detection signal provided by the potentiometer 22*a* based on the manipulation amount of the lift lever 22, the controller S controls rotation of the motor 31 and controls switching of the lift lowering proportional valve 32 and switching of the lift raising proportional valve 35. Using a detection signal sent from the potentiometer 23*a* based on the manipulation amount of the tilt lever 23, the controller S controls the rotation of the motor 31 and controls switching of the tilting proportional valve 37.

An inverter S1 is electrically connected to the controller S. A battery BT supplies electric power to the motor 31 through the inverter S1. The electric power generated by the motor 31 is stored in the battery BT through the inverter S1.

Operation of the hydraulic control device of the first embodiment will hereafter be described.

The controller S operates in the manner described below to perform respective independent operations, which are raising the fork 16, tilting the mast 13 forward, and tilting the mast 13 rearward. The independent operation means operation of the fork 16 without tilting the mast 13 forward or rearward or operation of the mast 13 without raising or lowering the fork 16.

To raise the fork 16, hydraulic fluid is delivered to the bottom chamber 14*b* of the lift cylinder 14. Accordingly, the controller S calculates the target rotation speed of the hydraulic pump/motor 30 and the valve opening degree of the lift raising proportional valve 35 that are necessary to perform fork raising at the speed instructed in correspondence with the manipulation amount of the lift lever 22. The controller S then controls the motor 31 in correspondence with the calculated target rotation speed as the instructed rotation speed of the motor 31 and opens the lift raising proportional valve 35 by the calculated valve opening degree at the first position 35*a*. To raise the fork 16, the controller S arranges the lift lowering proportional valve at the second position 32*b*.

In this manner, the hydraulic pump/motor 30 functions as the hydraulic pump through rotation of the motor 31 to draw hydraulic fluid from the fluid tank T and discharge the hydraulic fluid from the outlet port 30*b*. The hydraulic fluid is then delivered to the bottom chamber 14*b* via the lift raising proportional valve 35 and the check valve 36. This extends the lift cylinder 14 to raise the fork 16. To end the fork raising, the controller S switches the lift raising proportional valve 35 to the second position 35*b*.

To tilt the mast 13 rearward, hydraulic fluid is supplied to the rod chamber 19*r* of the tilt cylinder 19 and discharged from the bottom chamber 19*b*. Accordingly, the controller S calculates the target rotation speed of the hydraulic pump/motor 30 and the valve opening degree of the tilting proportional valve 37 that are necessary for rearward mast tilting at the speed instructed in correspondence with the manipulation amount of the tilt lever 23. The controller S then controls the motor 31 based on the calculated target rotation speed as the instructed rotation speed of the motor 31 and opens the tilting proportional valve 37 by the calculated valve opening degree at the second position 37*b*. To perform the rearward mast tilting, the controller S switches the lift lowering proportional valve 32 to the second position 32*b* and the lift raising proportional valve 35 to the second position 35*b*.

In this manner, the hydraulic pump/motor 30 functions as the hydraulic pump through rotation of the motor 31 to draw hydraulic fluid from the fluid tank T and discharge the hydraulic fluid from the outlet port 30*b*. The hydraulic fluid is then delivered to the rod chamber 19*r* via the check valve 40 and the tilting proportional valve 37. Meanwhile, the hydraulic fluid in the bottom chamber 19*b* is delivered to the fluid tank T through the tilting proportional valve 37. This retracts the tilt cylinder 19 to tilt the mast 13 rearward. To end the rearward mast tilting, the controller S switches the tilting proportional valve 37 at the first position 37*a*.

To tilt the mast 13 forward, hydraulic fluid is supplied to the bottom chamber 19*b* of the tilt cylinder 19 and discharged from the rod chamber 19*r*. Accordingly, the controller S calculates the target rotation speed of the hydraulic pump/motor 30 and the valve opening degree of the tilting proportional valve 37 that are necessary for forward mast tilting at the speed instructed in accordance with the manipulation amount of the tilt lever 23. The controller S then controls the motor 31 based on the calculated target rotation speed as the instructed rotation speed of the motor 31 and opens the tilting proportional valve 37 by the calculated valve opening degree at the third position 37*c*. To perform the forward mast tilting, the controller S arranges the lift lowering proportional valve 32 at the second position 32*b* and switches the lift raising proportional valve 35 to the second position 35*b*.

In this manner, the hydraulic pump/motor 30 functions as the hydraulic pump through rotation of the motor 31 to draw hydraulic fluid from the fluid tank T and discharge the hydraulic fluid from the outlet port 30*b*. The hydraulic fluid is then delivered to the bottom chamber 19*b* via the check valve 40 and the tilting proportional valve 37. Meanwhile, the hydraulic fluid in the rod chamber 19*r* is delivered to the fluid tank T through the tilting proportional valve 37. This extends the tilt cylinder 19 to tilt the mast 13 forward. To end the forward mast tilting, the controller S switches the tilting proportional valve 37 to the first position 37*a*.

Lowering the fork 16 as an independent operation and lowering the fork 16 and tilting the mast 13 forward or rearward as a simultaneous operation will hereafter be described with reference to FIGS. 3 and 4. The simultaneous operation refers to operating both the fork 16 and the mast 13 simultaneously in a certain period of time regardless of timings at which the fork 16 and the mast 13 start being operated.

Figure 3:
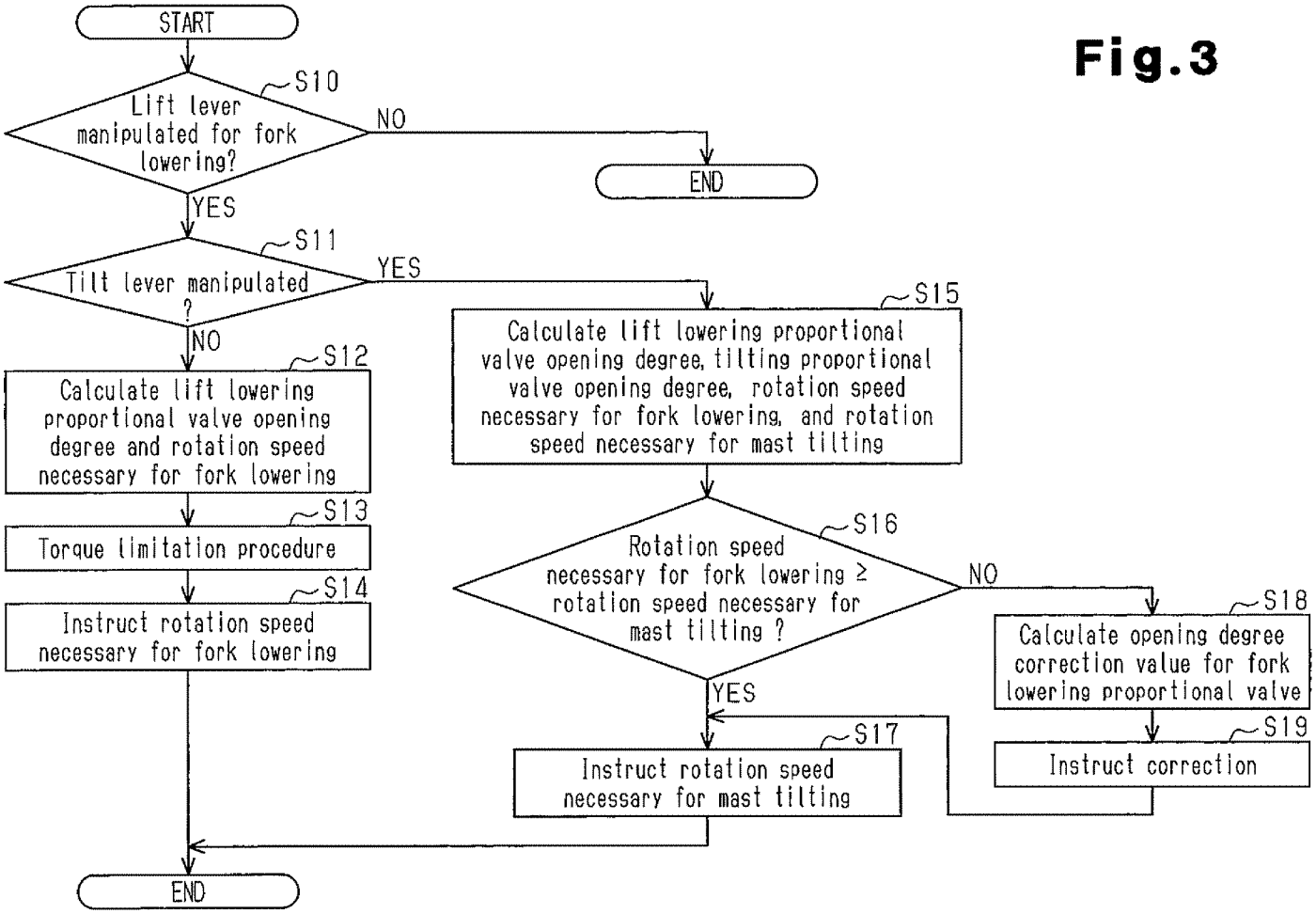
FIG. 3 is a flowchart representing the content of control for lowering the fork and then operating the fork and the mast simultaneously according to a first embodiment of the present invention.
Figure 4:
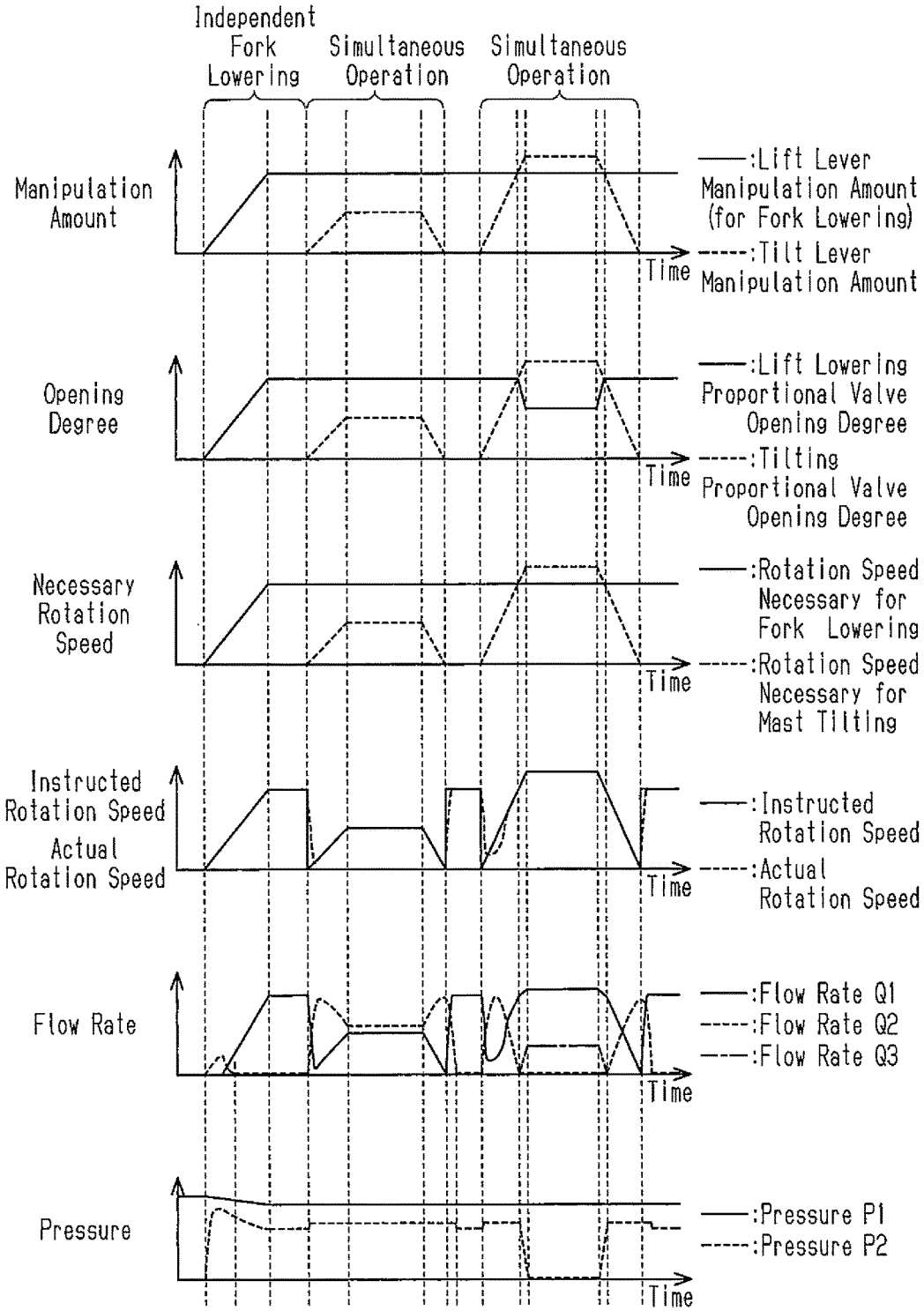
FIG. 4 is diagram representing characteristics at the time when the fork is lowered and then the fork and the mast are operated simultaneously.

With reference to FIG. 3, the controller S makes a positive determination in Step S10 when the lift lever 22 is manipulated to instruct fork lowering. Then, if the tilt lever 23 is not being manipulated at this stage and a negative determination is made in Step S11, the controller S performs control to lower the fork 16 as an independent operation. In such control, the controller S calculates the target rotation speed of the hydraulic pump/motor 30 and the valve opening degree of the lift lowering proportional valve 32 that are necessary for fork lowering at the speed instructed in accordance with the manipulation amount of the lift lever 22 (Step S12). Subsequently, the controller S performs a torque limitation procedure for controlling output torque of the motor 31 such that the motor 31 does not consume electric power unnecessarily when the fork lowering is performed (Step S13). In the torque limitation procedure, the controller S sets a torque limitation value to a predetermined value (for example, 0 Nm). The controller S then sets the target rotation speed calculated in Step S12 as the instructed rotation speed of the motor 31 (Step S14) and controls the motor 31 in accordance with the instructed rotation speed and the torque limitation value. Also, the controller S opens the lift lowering proportional valve 32 by the valve opening degree calculated in Step S12 at the first position 32*a*. Further, the controller S switches the lift raising proportional valve 35 to the second position 35*b* and the tilting proportional valve 37 to the first position 37*a* to perform the fork lowering as the independent operation.

When the lift lowering proportional valve 32 is open, the hydraulic fluid discharged from the bottom chamber 14*b* of the lift cylinder 14 is delivered to the hydraulic pump/motor 30 through the lift lowering proportional valve 32. At this stage, when the hydraulic pump/motor 30 operates at the instructed rotation speed using the hydraulic fluid discharged from the bottom chamber 14*b* as drive force, the motor 31 outputs negative torque and thus performs regenerative operation. In other words, the hydraulic pump/motor 30 functions as the hydraulic motor such that the motor 31 functions as a power generator. The electric power produced by the motor 31 functioning as the power generator is stored in the battery BT through the inverter S1. To end the fork lowering, the controller S switches the lift lowering proportional valve 32 to the second position 32*b*.

The regenerative operation can be performed when the fork 16 is lowered with a sufficiently heavy load mounted on the fork 16. In other words, when the fork lowering is carried out in this state, the weight of the fork 16 and the weight of the carried load may promote discharge of hydraulic fluid from the bottom chamber 14*b*. The hydraulic fluid is thus delivered to the hydraulic pump/motor 30 in correspondence with the valve opening degree of the lift lowering proportional valve 32 by the flow rate necessary for fork lowering at the speed instructed in accordance with the manipulation amount of the lift lever 22. Accordingly, the hydraulic pump/motor 30 is operated at the target rotation speed necessary for fork lowering at the speed instructed in accordance with the manipulation amount of the lift lever 22, which is the instructed rotation speed, even without powering operation of the motor 31. In the regenerative operation, the fork lowering speed is controlled using the valve opening degree of the lift lowering proportional valve 32.

The flow control valve 34 is switchable between a closed state and an open state at a desired opening degree in accordance with the difference between the pressure P1 and the pressure P2. In the first embodiment, when the lift lowering proportional valve 32 is at the second position 32*b* and fork lowering is not carried out, the flow control valve 34 is held in the closed state (at the first position 34*a*) in accordance with the difference between the pressure P1 and the pressure P2 (P1>P2). When the lift lowering proportional valve 32 is switched to the open state (the first position 32*a*) such that the hydraulic fluid flows, the difference between the pressure P1 and the pressure P2 decreases such that the flow control valve 34 is switched to the open state. In this state, the hydraulic fluid flows to the hydraulic pump/motor 30 through the pipe K1 (by the flow rate Q1 represented in FIG. 1) and to the fluid tank T (a draining portion) through the pipe K2 by the flow rate corresponding to the valve opening degree of the flow control valve 34 (by the flow rate Q2 represented in FIG. 1). Afterwards, the rotation speed of the hydraulic pump/motor 30 increases to increase the difference between the pressure P1 and the pressure P2 such that the flow control valve 34 is returned to the closed state. In this state, the hydraulic fluid flows only to the hydraulic pump/motor 30 through the pipe K1 (by the flow rate Q1 represented in FIG. 1). FIG. 4 represents various characteristics (manipulation amount, opening degree, target rotation speed, instructed rotation speed, flow rate, and pressure) at the time when fork lowering as an independent operation is performed in the above-described manner. The characteristics represented in FIG. 4 for the time when fork lowering is carried out as an independent operation may be exhibited when the above-described regenerative operation is performed.

When the fork lowering speed cannot be controlled using the valve opening degree of the lift lowering proportional valve 32 unlike the case of the regenerative operation, the flow control valve 34 is opened at a desired opening degree to operate to achieve the instructed fork lowering speed.

When the fork 16 carrying a comparatively light load is lowered, the weight of the fork 16 and the weight of the carried load cannot ensure discharge of hydraulic fluid from the bottom chamber 14*b*. This makes it unlikely that the hydraulic pump/motor 30 receives hydraulic fluid by a flow rate necessary for fork lowering at the speed instructed in accordance with the manipulation amount of the lift lever 22. Accordingly, to rotate the hydraulic pump/motor 30 at the instructed rotation speed to achieve the instructed speed, powering operation of the motor 31 is required. However, the powering operation of the motor 31 increases electric power consumption. To solve this problem, in the first embodiment, the hydraulic control device reduces such electric power consumption by carrying out torque limitation control. The torque limitation control of the motor 31 decreases the rotation speed of the motor 31 and there will be a shortage in the flow rate in relation to the value necessary for fork lowering at the instructed speed. The flow control valve 34 is thus operated to compensate for the shortage in the necessary flow rate.

Specifically, when the flow rate of the hydraulic fluid flowing to the hydraulic pump/motor 30 decreases, the pressure P2 is increased. This reduces the difference between the pressure P2 and the pressure P1 such that the flow control valve 34 is opened. The hydraulic fluid delivered from the lift cylinder 14 is thus divided into the hydraulic fluid flowing to the hydraulic pump/motor 30 (by the flow rate Q1 represented in FIG. 1) and the hydraulic fluid flowing to the fluid tank T (the draining portion) through the flow control valve 34 (by the flow rate Q2 represented in FIG. 1). That is, the flow control valve 34 opens the pipe K2, which is a hydraulic fluid passage, to compensate for the shortage in the aforementioned necessary flow rate. The speed instructed for the fork lowering is thus achieved. As has been described, if motor regenerative operation cannot be performed in fork lowering as an independent operation, the hydraulic control device of the first embodiment controls the motor 31 and operates the flow control valve 34 such that electric power consumption decreases and the speed instructed for the fork lowering is achieved.

When a positive determination is made in Step S11 of FIG. 3, the fork 16 is lowered and the mast 13 is tilted forward or rearward as a simultaneous operation in the manner described below.

In this case, the controller S calculates the target rotation speed of the hydraulic pump/motor 30 and the valve opening degree of the lift lowering proportional valve 32 that are necessary for fork lowering at the speed instructed in correspondence with the manipulation amount of the lift lever 22 (Step S15). The controller S also calculates the target rotation speed of the hydraulic pump/motor 30 and the valve opening degree of the tilting proportional valve 37 that are necessary for forward or rearward mast tilting at the speed instructed in correspondence with the manipulation amount of the tilt lever 23 in Step S15. Subsequently, the controller S compares the target rotation speed necessary for fork lowering with the target rotation speed necessary for forward or rearward mast tilting, which have been calculated in Step S15 (Step S16). When the target rotation speed necessary for fork lowering is greater than the target rotation speed necessary for forward or rearward mast tilting, a positive determination is made in Step 16 and Step S17 is performed by the controller S. In contrast, if the target rotation speed necessary for fork lowering is smaller than the target rotation speed necessary for forward or rearward mast tilting, a negative determination is made in Step S16, and Step S18 and the following steps are carried out by the controller S.

To perform the simultaneous operation, the hydraulic control device of the first embodiment employs the target rotation speed necessary for forward or rearward mast tilting as the instructed rotation speed of the motor 31, regardless of whether the determination of Step S16 is positive or negative. That is, if the determination of Step S16 is positive and thus Step S17 is performed by the controller S, the controller S sets the target rotation speed necessary for forward or rearward mast tilting calculated in Step S16 as the instructed rotation speed of the motor 31. Then, the controller S opens the lift lowering proportional valve 32 by the valve opening degree calculated in Step S15 at the first position 32*a* and opens the tilting proportional valve 37 by the valve opening degree calculated in Step S15 at the second position 37*b* or the third position 37*c*. Specifically, the controller S opens the tilting proportional valve 37 at the second position 37*b* when rearward mast tilting is performed and at the third position 37*c* when forward mast tilting is carried out. Also, the controller S switches the lift raising proportional valve 35 to the second position 35*b*.

When the target rotation speed necessary for fork lowering is greater than the target rotation speed necessary for forward or rearward mast tilting and the motor 31 is driven by the target rotation speed necessary for forward or rearward mast tilting as the instructed rotation speed, the problem described below occurs. That is, the actual rotation speed of the motor 31, which is the actual rotation speed of the hydraulic pump/motor 30, becomes insufficient for fork lowering, so that there will be a shortage in the flow rate necessary for fork lowering at the instructed speed. To solve this problem, the hydraulic control device of the first embodiment operates the flow control valve 34 to compensate for the shortage in the necessary flow rate.

Specifically, as the flow rate of the hydraulic fluid flowing to the hydraulic pump/motor 30 decreases, the pressure P2 increases. This reduces the difference between the pressure P2 and the pressure P1 such that the flow control valve 34 is opened. The hydraulic fluid delivered from the lift cylinder 14 is thus divided into the hydraulic fluid flowing to the hydraulic pump/motor 30 (by the flow rate Q1 represented in FIG. 1) and the hydraulic fluid flowing to the fluid tank T (the draining portion) through the flow control valve 34 (by the flow rate Q2 represented in FIG. 1). That is, the flow control valve 34 opens the pipe K2, which is a hydraulic fluid passage, to compensate for the shortage in the aforementioned necessary flow rate. The speed instructed for fork lowering is thus achieved. FIG. 4 shows various characteristics (manipulation amount, opening degree, target rotation speed, instructed rotation speed, flow rate, and pressure) at the time when the target rotation speed necessary for fork lowering is greater than the target rotation speed necessary for forward or rearward mast tilting and the simultaneous operation is performed in the above-described manner. As has been described, when the fork lowering and the forward or rearward mast tilting are performed as the simultaneous operation using the single hydraulic pump/motor 30 and the single motor 31, the hydraulic control device of the first embodiment achieves both the speed instructed for the fork lowering and the speed instructed for the forward or rearward mast tilting.

If the target rotation speed necessary for fork lowering is smaller than the target rotation speed necessary for forward or rearward mast tilting (if a negative determination is made in Step S16) and the motor 31 is rotated by the target rotation speed necessary for forward or rearward mast tilting as the instructed rotation speed, the problem described below occurs. That is, the actual rotation speed of the motor 31, which is the actual rotation speed of the hydraulic pump/motor 30, becomes excessively great for the fork lowering. This causes hydraulic fluid flow by a flow rate exceeding the flow rate necessary for fork lowering at the instructed speed. The fork lowering speed thus exceeds the instructed fork lowering speed. To solve this problem, after a negative determination is made in Step S16, the controller S of the hydraulic control device of the first embodiment calculates an opening degree correction value of the lift lowering proportional valve 32 in Step S18. In Step S18, using the difference between the target rotation speed necessary for fork lowering and the target rotation speed necessary for forward or rearward mast tilting, the controller S calculates the opening degree of the lift lowering proportional valve 32 corresponding to the flow rate matching the difference between the rotation speeds as the opening degree correction value. Subsequently, the controller S corrects the valve opening degree calculated in Step S15 based on the opening degree correction value determined in Step S18 (Step S19). Through such correction, the opening degree of the lift lowering proportional valve 32 is decreased by the amount corresponding to the opening degree correction value, compared with the valve opening degree calculated in Step S15.

Then, the controller S sets the target rotation speed necessary for forward or rearward mast tilting calculated in Step S15 as the instructed rotation speed of the motor 31. The controller S then opens the lift lowering proportional valve 32 by the valve opening degree corrected in Step S19 at the first position 32*a* and opens the tilting proportional valve 37 by the valve opening degree calculated in Step S15 at the second position 37*b* or the third position 37*c*. The controller S opens the tilting proportional valve 37 at the second position 37*b* to perform rearward mast tilting and at the third position 37*c* to carry out forward mast tilting. The controller S switches the lift raising proportional valve 35 to the second position 35*b*.

Through such control, the hydraulic control device of the first embodiment achieves the instructed speed for fork lowering by adjusting the opening degree of the lift lowering proportional valve 32 even when the motor 31 is operated by the target rotation speed necessary for forward or rearward mast tilting. On the other hand, when the opening degree of the lift lowering proportional valve 32 is adjusted, the flow rate of the hydraulic fluid flowing to the hydraulic pump/motor 30 through the lift lowering proportional valve 32 is decreased. In other words, there will be a shortage in the flow rate necessary for forward or rearward mast tilting at the instructed speed. In this case, hydraulic fluid is drawn (by a flow rate Q3 represented in FIG. 1) from the fluid tank T through the check valve 33, which is arranged between the hydraulic pump/motor 30 and the fluid tank T, such that the shortage in the flow rate is compensated for. The speed instructed for the forward or rearward mast tilting is thus achieved. FIG. 4 shows various characteristics (manipulation amount, opening degree, target rotation speed, instructed rotation speed, flow rate, and pressure) at the time when the target rotation speed necessary for fork lowering is smaller than the target rotation speed necessary for forward or rearward mast tilting and the simultaneous operation is performed in the above-described manner. As has been described, when performing the fork lowering and the forward or rearward mast tilting as the simultaneous operation including the fork lowering and the forward or rearward mast tilting using the single hydraulic pump/motor 30 and the single motor 31, the hydraulic control device of the first embodiment achieves both the speed instructed for the fork lowering and the speed instructed for the forward or rearward mast tilting. When the target rotation speed necessary for fork lowering is smaller than the target rotation speed necessary for forward or rearward mast tilting, the flow control valve 34 is closed.

Accordingly, the first embodiment has the advantages described below.

(1) The flow control valve 34 is mounted between the lift lowering proportional valve 32 and the fluid tank T. Accordingly, when there is a shortage in the target rotation speed necessary for fork lowering, the flow control valve 34 delivers hydraulic fluid to the fluid tank T by an amount that compensates for the shortage in the target rotation speed. As a result, the fork 16 is lowered at the speed instructed in correspondence with the manipulation amount of the lift lever 22.

(2) In the simultaneous operation in which the fork 16 is lowered and the mast 13 is tilted forward or rearward, such fork lowering and forward or rearward mast tilting are performed each at the instructed speed even when the target rotation speed necessary for forward or rearward tilting of the mast 13 is used as the instructed rotation speed of the motor 31. In other words, there is shortage in the target rotation speed necessary for fork lowering, the flow control valve 34 delivers hydraulic fluid to the fluid tank T by an amount that corresponds to the shortage in the target rotation speed. The speed instructed for the fork lowering is thus ensured.

(3) In the simultaneous operation in which the fork 16 is lowered and the mast 13 is tilted forward or rearward, such fork lowering and forward or rearward mast tilting are performed each at the instructed speed even when the target rotation speed necessary for forward or rearward tilting of the mast 13 is used as the instructed rotation speed of the motor 31. In other words, when the fork lowering speed exceeds the instructed speed, the opening degree of the lift lowering proportional valve 32 is adjusted to achieve the speed instructed for the fork lowering. If such opening degree adjustment of the lift lowering proportional valve 32 causes a shortage in the flow rate of the hydraulic fluid flowing to the hydraulic pump/motor 30, hydraulic fluid is drawn from the fluid tank T through the check valve 33 and then delivered to the tilting proportional valve 37. The speed instructed for the forward or rearward tilting of the mast 13 is thus achieved.

(4) When the fork 16 is lowered as an independent operation and powering operation of the motor 31 is performed, the motor 31 is controlled (subjected to torque limitation) and the flow control valve 34 is operated to decrease electric power consumption and achieve the speed instructed for lowering the fork 16.

(5) The flow control valve 34 is selectively opened and closed in by pressure difference. This simplifies the configuration and control of the hydraulic control device compared with a case in which the valve opening degree is electrically regulated.

(6) Even though the hydraulic control device is configured by the single hydraulic pump/motor 30 and the single motor 31, the flow control valve 34 is operated to achieve the speed instructed for each of the operations. This saves cost necessary for the hydraulic control device as a whole compared with a case employing a hydraulic control device configured by a plurality of hydraulic pumps motors and a plurality of motors.

Second Embodiment

A hydraulic control device according to a second embodiment of the present invention will now be described with reference to FIGS. 1, 5, and 6. Same or like reference numerals are given to components of the second embodiment that are the same as or like corresponding components of the first embodiment. Description of these components is omitted or simplified herein.

Figure 1:
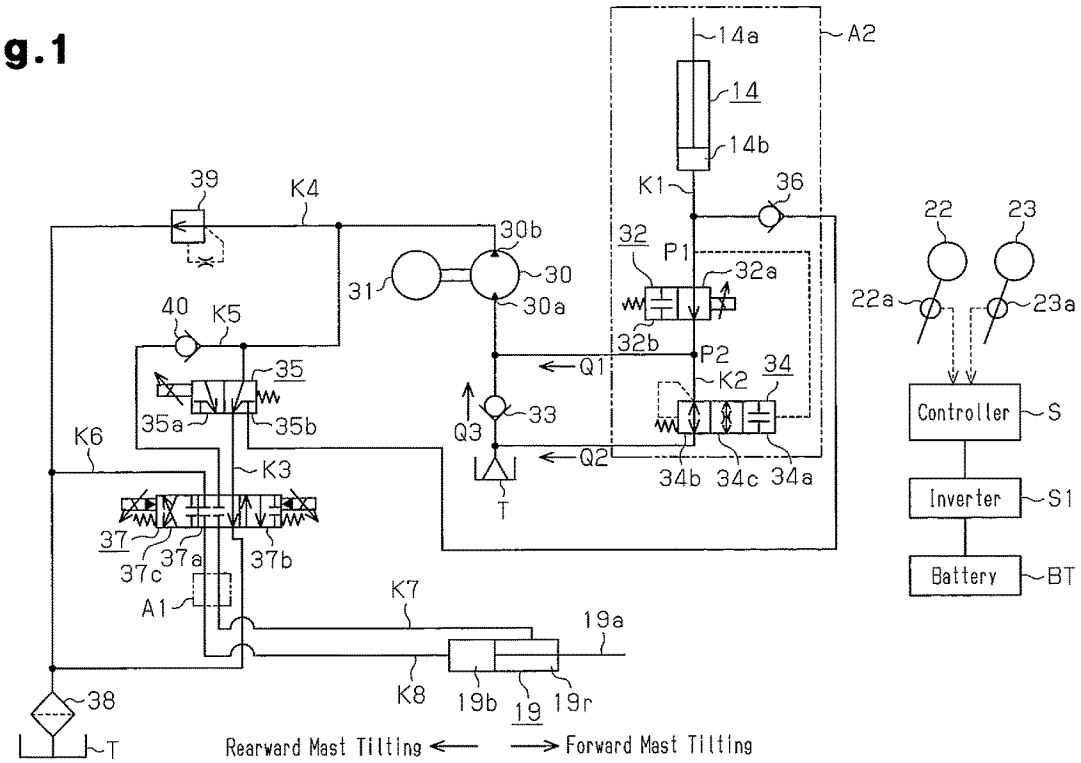
FIG. 1 is a circuit diagram representing a hydraulic control device for a forklift.

In the hydraulic control device of the second embodiment, a pressure compensating valve A1 (represented by the broken lines in which a long dash alternates with a pair of short dashes in FIG. 1) is arranged between the tilting proportional valve 37 and the tilt cylinder 19. The pressure compensating valve A1 adjusts the flow rate at the time when the pressure of the hydraulic fluid flowing to the tilt cylinder 19 exceeds a set pressure. The set pressure is set in accordance with the manipulation amount of the tilt lever 23. If the flow rate of the hydraulic fluid delivered from the hydraulic pump/motor 30 to the tilt cylinder 19 is greater than the flow rate necessary for the speed instructed in accordance with the manipulation amount of the tilt lever 23, the pressure compensating valve A1 adjusts the flow rate. This increases the pressure acting in the zone between the hydraulic pump/motor 30 and the tilting proportional valve 37. When such pressure exceeds relief pressure, which is set for the relief valve 39, hydraulic fluid is delivered to the fluid tank T through the relief valve 39. For this purpose, the pressure compensating valve A1 is mounted between the tilting proportional valve 37 and the tilt cylinder 19 in the hydraulic control device of the second embodiment. Accordingly, even when the flow rate of the hydraulic fluid delivered from the hydraulic pump/motor 30 to the tilt cylinder 19 is greater than the flow rate necessary for the speed instructed in accordance with the manipulation amount of the tilt lever 23, forward or rearward mast tilting is performed at the speed instructed in accordance with the manipulation amount of the tilt lever 23. In the second embodiment, the pressure compensating valve A1 and the relief valve 39 configure a flow rate adjustment mechanism for adjusting the flow rate.

Operation of the hydraulic control device of the second embodiment will hereafter be described.

The description below is focused on a simultaneous operation performed when the target rotation speed necessary for fork lowering is greater than the target rotation speed necessary for forward or rearward mast tilting. Other types of operation are carried out in the same manners as the first embodiment.

Figure 5:
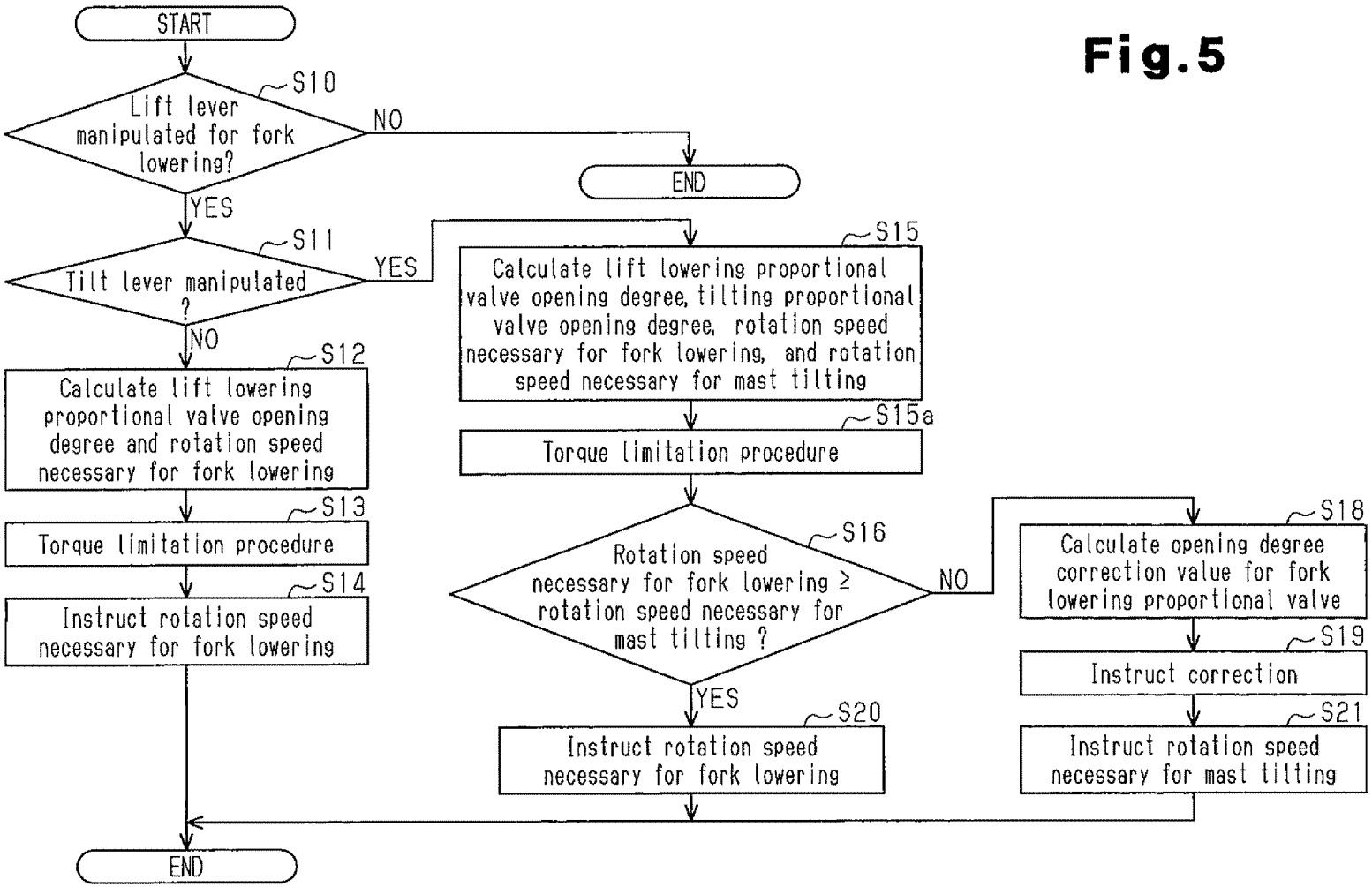
FIG. 5 is a flowchart representing the content of control for lowering the fork and then operating the fork and the mast simultaneously according to a second embodiment of the invention.

With reference to FIG. 5, the controller S calculates the respective target rotation speeds and valve opening degrees in Step S15 and performs a torque limitation procedure for limiting the torque output from the motor 31 (Step S15*a*). In the torque limitation procedure, the controller S sets a predetermined value (for example, 0 Nm) for the torque limitation value. The hydraulic control device of the second embodiment carries out torque limitation control based on the torque limitation value when powering operation of the motor 31 is carried out and the motor 31 is operated by a rotation speed greater than the target rotation speed necessary for forward or rearward mast tilting.

After Step S15*a*, the controller S compares the target rotation speed necessary for fork lowering calculated in Step S15 with the target rotation speed necessary for forward or rearward mast tilting in Step S16. When a positive determination is made in Step S16, or the target rotation speed necessary for fork lowering is greater than the target rotation speed necessary for forward or rearward mast tilting, the target rotation speed necessary for fork lowering is set as the instructed rotation speed of the motor 31. The controller S opens the lift lowering proportional valve 32 by the valve opening degree calculated in Step S15 at the first position 32*a* and opens the tilting proportional valve 37 by the valve opening degree determined in Step S15 at the second position 37*b* or the third position 37*c*. In contrast, if a negative determination is made in Step S16, the controller S performs Steps S18 and S19 as in the case of the first embodiment. The controller S then sets the target rotation speed necessary for forward or rearward mast tilting as the instructed rotation speed of the motor 31 in Step S21.

When performing control based on the target rotation speed necessary for fork lowering used as the instructed rotation speed of the motor 31, the hydraulic control device of the second embodiment operates in the manner specified below with reference to FIG. 6.

Figure 6:
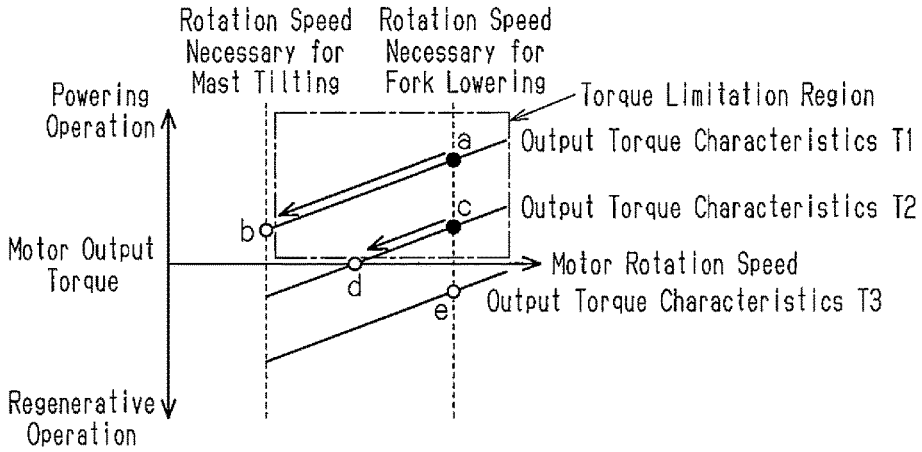
FIG. 6 is a diagram representing changes in the rotation speed of the motor under torque limitation.

FIG. 6 represents three types of output torque characteristics of the motor 31 exhibited under various conditions including the load weight, the lift height, the tilt angle, and the target rotation speed necessary for fork lowering, by way of example.

Output torque characteristics T1 can be exhibited when the lift lever 22 is fully manipulated to lower a load weighing 0 kg from the maximum lift height position and the tilt lever 23 is slightly manipulated to tilt the load rearward from the maximum forward tilt position. When the motor 31 is operated at the target rotation speed necessary for fork lowering (at point a in FIG. 6) under the output torque characteristics T1, with reference to FIG. 6, powering operation of the motor 31 is brought about. Accordingly, the controller S decreases the actual rotation speed of the motor 31 (the actual rotation speed of the hydraulic pump/motor 30) by driving the motor 31 through torque limitation. In this example, the rotation speed after the torque limitation is switched to the target rotation speed necessary for forward or rearward mast tilting (at point b in FIG. 6). Specifically, if the rotation speed is decreased to a value less than the target rotation speed necessary for forward or rearward mast tilting, the speed instructed for the forward or rearward mast tilting cannot be achieved. The controller S thus performs control using the target rotation speed necessary for forward or rearward mast tilting as the lower limit value. This decreases the electric power consumed by the motor 31.

However, the aforementioned torque limitation leads to a shortage in the flow rate necessary to perform fork lowering at the speed instructed for the fork lowering. To solve this problem, the hydraulic control device of the second embodiment operates the flow control valve 34 to compensate for the shortage in the aforementioned necessary flow rate as in the case of the hydraulic control device of the first embodiment. Specifically, as the actual rotation speed of the motor 31 is decreased, the flow rate of the hydraulic fluid flowing to the hydraulic pump/motor 30 is reduced. This raises the pressure P2 and decreases the difference between the pressure P2 and the pressure P1 such that the flow control valve 34 is opened. In this manner, the hydraulic fluid delivered from the lift cylinder 14 is divided into the hydraulic fluid flowing to the hydraulic pump/motor 30 (by the flow rate Q1 represented in FIG. 1) and the hydraulic fluid delivered to the fluid tank T (the draining portion) via the flow control valve 34 (by the flow rate Q2 represented in FIG. 1). As a result, the flow control valve 34 opens the pipe K2, which is a hydraulic fluid passage, to compensate for the shortage in the aforementioned necessary flow rate. The speed instructed for fork lowering is thus achieved. On the other hand, the speed instructed for forward or rearward mast tilting is achieved under the output torque characteristics T1 by operating the motor 31 at the target rotation speed necessary for forward or rearward mast tilting.

Output torque characteristics T2 can be exhibited when the lift lever 22 is fully manipulated to lower a load weighing X kg (X>0, for example, 1500 kg) from the maximum lift height position and the tilt lever 23 is slightly manipulated to tilt the load rearward from the maximum forward tilt position. When the motor 31 is operated at the target rotation speed necessary for fork lowering (at point c in FIG. 6) under the output torque characteristics T2, with reference to FIG. 6, powering operation of the motor 31 is brought about. Accordingly, the controller S decreases the actual rotation speed of the motor 31 (the actual rotation speed of the hydraulic pump/motor 30) by driving the motor 31 through torque limitation, as in the case where the output torque characteristics T1 are exhibited). In this example, the rotation speed after the torque limitation is switched to such a rotation speed that the output torque is 0 Nm (at point d in FIG. 6). The electric power consumed by the motor 31 is thus decreased. Specifically, the aforementioned rotation speed is greater than the target rotation speed necessary for forward or rearward mast tilting.

Then, when the above-described torque limitation is performed, there will be a shortage in the flow rate necessary for the speed instructed for fork lowering. To solve this problem, the hydraulic control device of the second embodiment operates the flow control valve 34 to compensate for the shortage in the aforementioned necessary flow rate as in the case of the hydraulic control device of the first embodiment. Specifically, the flow control valve 34 operates in the same manner as when the flow control valve 34 operates under the output torque characteristics T1. However, under the output torque characteristics T2, the motor 31 is operated at a rotation speed greater than the target rotation speed necessary for forward or rearward mast tilting. As a result, the hydraulic pump/motor 30 discharges hydraulic fluid by an amount greater than the flow rate necessary for achieving the speed instructed for forward or rearward mast tilting. If the hydraulic fluid is delivered to the tilting proportional valve 37 by this flow rate, the forward or rearward mast tilting is carried out at a speed higher than the instructed speed. However, as shown in FIG. 1, the hydraulic control device of the second embodiment has the pressure compensating valve A1, which is mounted between the tilting proportional valve 37 and the tilt cylinder 19. The pressure compensating valve A1 is operated to adjust the flow rate to the flow rate necessary for the instructed speed. As a result, the speed instructed for forward or rearward mast tilting is ensured.

Output torque characteristics T3 may be exhibited when the lift lever 22 is slightly manipulated to lower a load weighing X kg (X>0, for example, 1500 kg) from the maximum lift height position and the tilt lever 23 is slightly manipulated to tilt the load forward to an angle close to the maximum forward tilt position. When the motor 31 is operated at the target rotation speed necessary for fork lowering (at point e in FIG. 6) under the output torque characteristics T3, with reference to FIG. 6, the output torque of the motor 31 is negative and regenerative operation of the motor 31 is brought about. When the regenerative operation of the motor 31 is caused as in the case where the output torque characteristics T3 are exhibited, control is performed using the target rotation speed necessary for fork lowering as the instructed rotation speed.

On the other hand, under the output torque characteristics T3, the motor 31 operates at a rotation speed greater than the target rotation speed necessary for forward or rearward mast tilting. As a result, the hydraulic pump/motor 30 discharges hydraulic fluid by a flow rate greater than the flow rate necessary for the speed instructed for forward or rearward mast tilting. If the tilting proportional valve 37 receives hydraulic fluid by this flow rate, forward or rearward mast tilting is performed at a speed greater than the instructed speed. To solve this problem, the hydraulic control device of the second embodiment operates the pressure compensating valve A1 to adjust the flow rate to the flow rate necessary for the instructed speed, as has been described. As a result, the speed instructed for forward or rearward mast tilting is achieved.

The second embodiment has the advantages described below in addition to the advantages (1) and (3) to (6) of the first embodiment.

(7) In the simultaneous operation, in which the fork 16 is lowered and the mast 13 is tilted forward or rearward, fork lowering and mast tilting are performed each at the instructed speed even if the greater one of the target rotation speed necessary for fork lowering and the target rotation speed necessary for forward or rearward mast tilting is employed as the instructed speed of the motor 31. Specifically, even when there is a shortage in the rotation speed necessary for fork lowering, the flow control valve 34 delivers hydraulic fluid to the fluid tank T by a flow rate that corresponds to the shortage in the necessary rotation speed. This ensures the speed instructed for fork lowering. Also, the pressure compensating valve A1 and the relief valve 39 operate to adjust the flow rate of the hydraulic fluid flowing to the tilt cylinder 19 to a necessary amount, thus ensuring forward or rearward tilting of the mast 13 at the instructed speed.

(8) When the target rotation speed necessary for fork lowering is used as the instructed speed of the motor 31, the motor 31 is controlled (subjected to torque limitation) in correspondence with the output torque characteristics of the motor 31. This saves electric power consumption. Also, the flow control valve 34 is operated to achieve the speed instructed for fork lowering.

The above described embodiments may be modified as follows.

The torque limitation value set in the torque limitation procedure of Steps S13 and S15*a* in FIGS. 3 and 5 may be set to a value greater than or equal to 0 Nm, which is, for example, 5 Nm.

Figure 7:
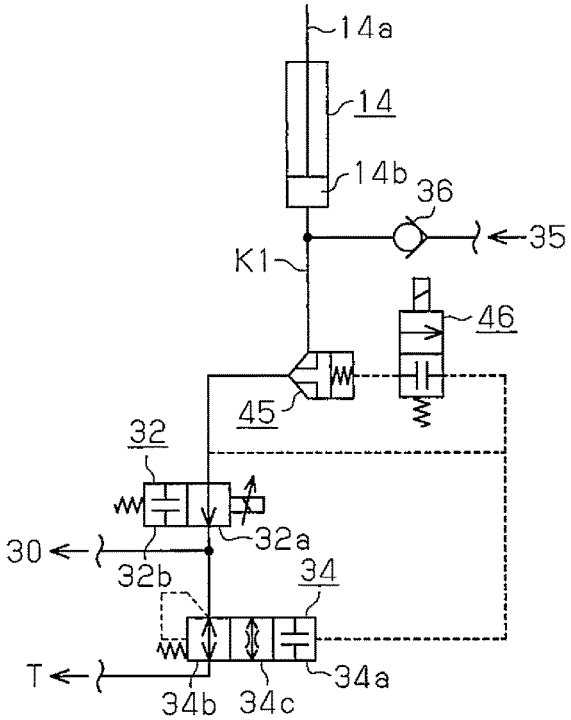
FIG. 7 is a circuit diagram representing a portion of a hydraulic control device of a modification.

FIG. 7 illustrates a region corresponding to region A2, which is represented by the broken line in which a long dash alternates with a pair of short dashes in FIG. 1. With reference to FIG. 7, the outflow control mechanism may be configured by a poppet valve 45 and an electromagnetic valve 46, in addition to the lift lowering proportional valve 32. When fork lowering is carried out, the poppet valve 45 and the electromagnetic valve 46 are opened and the flow rate of the hydraulic fluid flowing to the hydraulic pump/motor 30 is adjusted in accordance with the opening degree of the lift lowering proportional valve 32. The flow control valve 34 is opened by the difference between the pressure in the zone between the lift cylinder 14 and the lift lowering proportional valve 32 and the pressure in the zone between the lift lowering proportional valve 32 and the hydraulic pump/motor 30.

Figure 8:
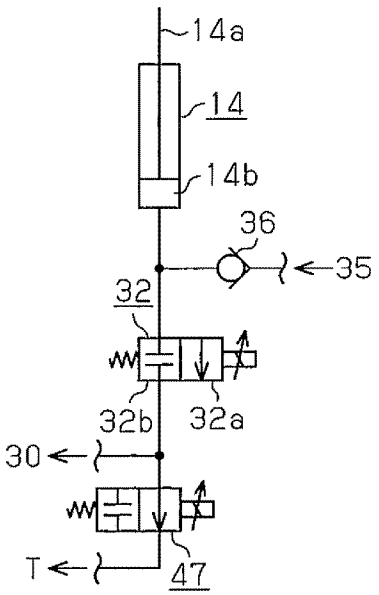
FIG. 8 is a circuit diagram representing a portion of a hydraulic control device of a modification.

FIG. 8 illustrates a region corresponding to region A2, which is represented by the broken line in which a long dash alternates with a pair of short dashes in FIG. 1. As illustrated in FIG. 8, an electromagnetic proportional valve 47 serving as a flow control valve may be mounted between the hydraulic pump/motor 30 and the lift lowering proportional valve 32. In this case, if the actual rotation speed of the motor 31 is less than the target rotation speed necessary for fork lowering, the controller S opens the electromagnetic proportional valve 47 by an opening degree corresponding to the difference between the actual rotation speed and the target rotation speed of the motor 31. As a result, as in the illustrated embodiments, the speed instructed for fork lowering is achieved.

Figure 9:
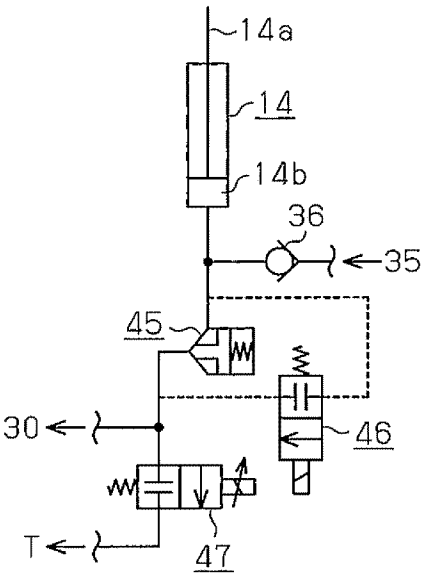
FIG. 9 is a circuit diagram representing a portion of a hydraulic control device of a modification.

FIG. 9 illustrates a region corresponding to region A2, which is represented by the broken line in which a long dash alternates with a pair of short dashes in FIG. 1. As illustrated in FIG. 9, an electromagnetic proportional valve 47 serving as a flow control valve may be mounted between the outflow control mechanism and the hydraulic pump/motor 30. In this case, the outflow control mechanism is configured by a poppet valve 45 and an electromagnetic valve 46. In fork lowering, the poppet valve 45 and the electromagnetic valve 46 are opened and the flow rate of the hydraulic fluid flowing to the hydraulic pump/motor 30 is controlled in correspondence with the opening degree of the poppet valve 45. If the actual rotation speed of the motor 31 is less than the target rotation speed necessary for fork lowering, the controller S opens the electromagnetic proportional valve 47 by an opening degree corresponding to the difference between the actual rotation speed and the target rotation speed of the motor 31. As a result, as in the illustrated embodiments, the speed instructed for fork lowering is achieved.

Figure 10:
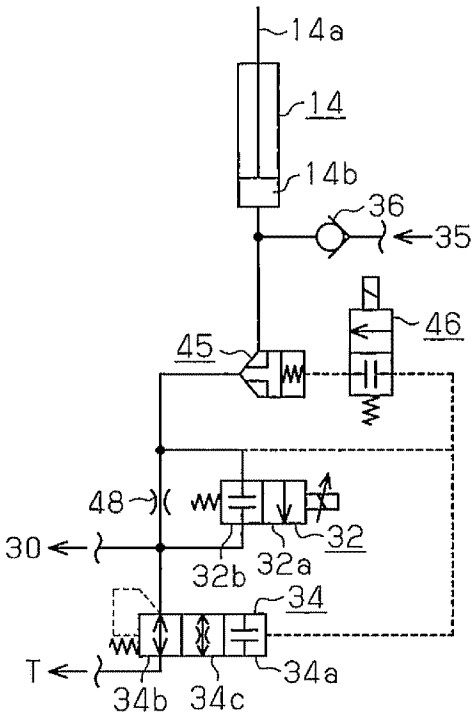
FIG. 10 is a circuit diagram representing a portion of a hydraulic control device of a modification.

FIG. 10 illustrates a region corresponding to region A2, which is represented by the broken line in which a long dash alternates with a pair of short dashes in FIG. 1. With reference to FIG. 10, the outflow control mechanism may be configured by a poppet valve 45, an electromagnetic valve 46, and an orifice 48 in addition to the lift lowering proportional valve 32. When fork lowering is carried out, the poppet valve 45 and the electromagnetic valve 46 are opened and the flow rate of the hydraulic fluid flowing to the hydraulic pump/motor 30 is regulated by the opening degree of the lift lowering proportional valve 32. The flow control valve 34 is opened by the difference between the pressure in the zone between the lift cylinder 14 and the lift lowering proportional valve 32 and the pressure in the zone between the lift lowering proportional valve 32 and the hydraulic pump/motor 30.

Figure 11:
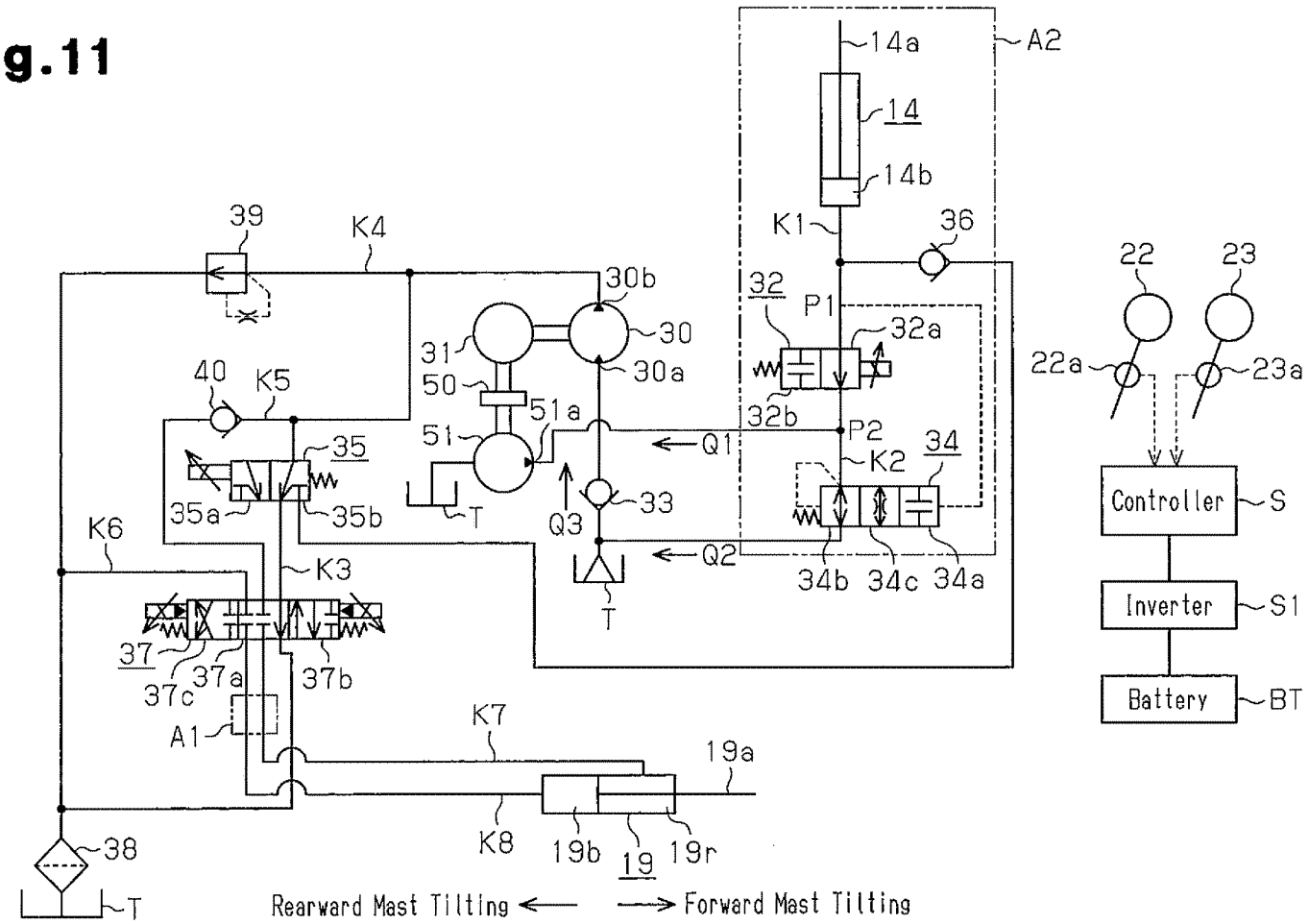
FIG. 11 is a circuit diagram representing a hydraulic control device of a modification.

In each of the illustrated embodiments, the hydraulic control device has the single hydraulic pump/motor 30. However, as illustrated in FIG. 11, a hydraulic pump/motor 51 may be connected to the motor 31, which is connected to the hydraulic pump/motor 30, such that the hydraulic control device includes the multiple hydraulic pump/motors 30, 51. In this modification, a power transmission device 50 is connected to the rotary shaft of the motor 31 and the rotary shaft of the hydraulic pump/motor 51. The power transmission device 50 is a one-way clutch and permits drive torque transmission only in one direction, or, in other words, from the hydraulic pump/motor 51 to the motor 31. The power transmission device 50 operates blankly with respect to the drive torque from the motor 31 and prevents the drive torque from transmitting to the hydraulic pump/motor 51. An inlet port 51*a* of the hydraulic pump/motor 51 is connected to the fluid outlet side of the lift lowering proportional valve 32 through a pipe. As a result, the hydraulic fluid discharged from the bottom chamber 14*b* of the lift cylinder 14 (by the flow rate Q1 represented in FIG. 11) is delivered to the inlet port 51*a* of the hydraulic pump/motor 51 without flowing to the inlet port 30*a* of the hydraulic pump/motor 30, unlike the illustrated embodiments. The hydraulic fluid is then delivered from the hydraulic pump/motor 51 to the fluid tank T.

In the hydraulic control device illustrated in FIG. 11, the hydraulic fluid flowing from the bottom chamber 14*b* of the lift cylinder 14 to the hydraulic pump/motor 51 via the lift lowering proportional valve 32 is used to operate the hydraulic pump/motor 51 as a hydraulic motor. When the hydraulic pump/motor 51 operates as the hydraulic motor, the drive torque of the hydraulic pump/motor 51 is transmitted to the motor 31 through the power transmission device 50 to operate the motor 31 as an electric power generator. The electric power produced by the motor 31 is stored in the battery BT via the inverter S1. That is, regenerative operation is performed.

When the hydraulic control device illustrated in FIG. 11 lowers the fork 16 as an independent operation, the regenerative operation is carried out. As has been described for the illustrated embodiments, if the valve opening of the lift lowering proportional valve 32 does not allow the fork lowering speed to be controlled at the instructed speed, the hydraulic control device illustrated in FIG. 11 opens the flow control valve 34 by a desired opening value in accordance with the difference between the pressure P1 and the pressure P2 to achieve the instructed speed. In other words, by opening the flow control valve 34, hydraulic fluid is delivered to the pipe K2 (the draining portion) by an amount that corresponds to the shortage in the flow rate necessary to perform fork lowering at the instructed speed.

When the hydraulic control device illustrated in FIG. 11 lowers the fork 16 and tilts the mast 13 forward or rearward simultaneously, the hydraulic control device may operate according to the same control contents as the control contents of the first embodiment. Specifically, when the motor 31 is operated at the target rotation speed necessary for forward or rearward mast tilting as the instructed rotation speed and the target rotation speed necessary for fork lowering is smaller than the target rotation speed necessary for forward or rearward mast tilting, the drive torque produced by the hydraulic pump/motor 51 functioning as the hydraulic motor is transmitted to the motor 31. The drive torque is thus supplied to the motor 31 as assist torque for rotating the motor 31. This saves electric power consumption and achieves the speed instructed for forward or rearward mast tilting and the speed instructed for fork lowering. If the target rotation speed necessary for fork lowering is greater than the target rotation speed necessary for forward or rearward mast tilting, the instructed rotation speed of the motor 31 is controlled at the target rotation speed necessary for forward or rearward mast tilting. In this case, there will be a shortage in the flow rate necessary to perform fork lowering at the instructed speed. However, as in the above-described case, the flow control valve 34 is opened to compensate for the shortage in the aforementioned necessary flow rate, and thus the instructed speed is achieved.

When the hydraulic control device illustrated in FIG. 11 lowers the fork 16 and tilts the mast 13 forward or rearward simultaneously, the hydraulic control device may operate according to the same control contents as the control contents of the second embodiment. Specifically, if the target rotation speed necessary for forward or rearward mast tilting is comparatively great and the motor 31 is operated at this target rotation speed as the instructed rotation speed, the drive torque generated by the hydraulic pump/motor 51 functioning as the hydraulic motor is transmitted to the motor 31. The drive torque is supplied to the motor 31 as assist torque for rotating the motor 31 to save electric power consumption and achieve the speed instructed for forward or rearward mast tilting and the speed instructed for fork lowering. If the rotation speed necessary for fork lowering is comparatively great and the motor 31 is operated at this target rotation speed as the instructed rotation speed, torque limitation is performed in accordance with the output torque characteristics of the motor 31. This saves electric power consumption and achieves the speed instructed for forward or rearward mast tilting and the speed instructed for fork lowering. In this case, if there is a shortage in the flow rate necessary to perform fork lowering at the instructed speed, the flow control valve 34 is opened to compensate for the shortage in the necessary flow rate to achieve the instructed speed, as in the above-described case. If forward or rearward mast tilting is carried out at a speed greater than the instructed speed, the pressure compensating valve A1 operates to adjust the flow rate to the flow rate necessary for the instructed speed.

The invention claimed is:

1. A hydraulic control device for a forklift, wherein the hydraulic control device selectively raises and lowers a fork by supplying hydraulic fluid to a lift cylinder or discharging hydraulic fluid from the lift cylinder through manipulation of a raising/lowering instruction member, the hydraulic control device tilts a mast to which the fork is attached selectively forward and rearward by supplying hydraulic fluid to a tilt cylinder and/or discharging hydraulic fluid from the tilt cylinder through manipulation of a tilting instruction member, the hydraulic control device comprises:

at least one hydraulic pump;

a single electric motor for driving the hydraulic pump;

an outflow control mechanism arranged between the lift cylinder and the hydraulic pump, wherein the outflow control mechanism permits hydraulic fluid to flow from a bottom chamber of the lift cylinder to the hydraulic pump when the fork is lowered, and the outflow control mechanism prohibits hydraulic fluid from flowing from the bottom chamber of the lift cylinder to the hydraulic pump when the fork is in a stopped or raised state;

a flow control valve arranged between the outflow control mechanism and a draining portion; and a controller that controls the electric motor, wherein, when the fork is lowered and, simultaneously, the mast is tilted forward or rearward, the controller controls the electric motor based on a target rotation speed of the hydraulic pump necessary for operation at an instructed speed corresponding to a manipulation amount of the raising/lowering instruction member or a manipulation amount of the tilting instruction member, wherein, in order to obtain a flow rate of hydraulic fluid flowing from the lift cylinder corresponding to the target rotation speed of the hydraulic pump necessary to lower the fork at the instructed speed, the flow control valve controls a flow rate of the hydraulic fluid flowing from the lift cylinder to the hydraulic pump and a flow rate of the hydraulic fluid flowing from the lift cylinder to the draining portion in correspondence with a difference between an actual rotation speed of the hydraulic pump and the target rotation speed of the hydraulic pump necessary to lower the fork at the instructed speed corresponding to the manipulation amount of the raising/lowering instruction member.

2. The hydraulic control device according to claim 1, wherein, when the actual rotation speed of the hydraulic pump is short in relation to the target rotation speed of the hydraulic pump necessary to lower the fork at the instructed speed corresponding to the manipulation amount of the raising/lowering instruction member, the flow control valve delivers the flow rate of the hydraulic fluid flowing from the lift cylinder to the draining portion by a flow rate corresponding to a shortage in the rotation speed.

3. The hydraulic control device according to claim 2, wherein the controller controls the electric motor based on the target rotation speed of the hydraulic pump necessary to tilt the mast forward or rearward at the instructed speed corresponding to the manipulation amount of the tilting instruction member, and when the target rotation speed of the hydraulic pump necessary to lower the fork at the instructed speed corresponding to the manipulation amount of the raising/lowering instruction member is greater than the actual rotation speed of the hydraulic pump, the flow control valve delivers the flow rate of the hydraulic fluid flowing from the lift cylinder to the draining portion by a flow rate corresponding to the shortage in the rotation speed.

4. The hydraulic control device according to claim 2, wherein the controller controls the electric motor based on the greater one of the target rotation speed of the hydraulic pump necessary to lower the fork at the instructed speed corresponding to the manipulation amount of the raising/lowering instruction member and the target rotation speed of the hydraulic pump necessary to tilt the mast forward or rearward at the instructed speed corresponding to the manipulation amount of the tilting instruction member, and the hydraulic control device further comprises a flow rate adjustment mechanism arranged between the hydraulic pump and the tilt cylinder, wherein the flow rate adjustment mechanism adjusts the flow rate of the hydraulic fluid discharged from the hydraulic pump to a flow rate necessary to tilt the mast forward or rearward at the instructed speed corresponding to the manipulation amount of the tilting instruction member.

5. The hydraulic control device according to claim 2, wherein the outflow control mechanism includes an electromagnetic proportional valve having an adjustable opening degree, when the fork is lowered, the controller adjusts an opening degree of the electromagnetic proportional valve to deliver the flow rate of the hydraulic fluid flowing from the lift cylinder to the hydraulic pump and the flow rate of the hydraulic fluid flowing from the lift cylinder to the drain portion by a flow rate necessary for the instructed speed corresponding to the manipulation amount of the raising/lowering instruction member, and when the fork and the mast are operated simultaneously and the target rotation speed of the hydraulic pump necessary to lower the fork at the instructed speed corresponding to the manipulation amount of the raising/lowering instruction member is less than the target rotation speed of the hydraulic pump necessary to tilt the mast forward or rearward at the instructed speed corresponding to the manipulation amount of the tilting instruction member, the controller adjusts the opening degree of the electromagnetic proportional valve to restrict outflow of hydraulic fluid by a flow rate corresponding to the difference between the target rotation speed of the hydraulic pump necessary to lower the fork at the instructed speed corresponding to the manipulation amount of the raising/lowering instruction member and the target rotation speed of the hydraulic pump necessary to tilt the mast forward or rearward at the instructed speed corresponding to the manipulation amount of the tilting instruction member and the flow control valve delivers the flow rate of the hydraulic fluid flowing from the lift cylinder to the hydraulic pump.

6. The hydraulic control device according to claim 1, wherein the flow control valve regulates the flow rate of hydraulic fluid flowing from the lift cylinder to the draining portion by adjusting an opening degree of the flow control valve in correspondence with a difference between a pressure in a portion between the lift cylinder and the outflow control mechanism and a pressure in a portion between the outflow control mechanism and the hydraulic pump.

7. A hydraulic control device for a forklift, wherein the hydraulic control device selectively raises and lowers a fork by supplying hydraulic fluid to a lift cylinder or discharging hydraulic fluid from the lift cylinder through manipulation of a raising/lowering instruction member, the hydraulic control device tilts a mast to which the fork is attached selectively forward and rearward by supplying hydraulic fluid to a tilt cylinder and/or discharging hydraulic fluid from the tilt cylinder through manipulation of a tilting instruction member, the hydraulic control device comprises:

a single hydraulic pump;

a single electric motor for driving the hydraulic pump;

an outflow control mechanism arranged between the lift cylinder and the hydraulic pump, wherein the outflow control mechanism permits hydraulic fluid to flow from a bottom chamber of the lift cylinder to the hydraulic pump when the fork is lowered, the outflow control mechanism prohibits hydraulic fluid from flowing from the bottom chamber of the lift cylinder to the hydraulic pump when the fork is in a stopped or raised state;

a flow control valve arranged between the hydraulic pump and the outflow control mechanism; and a controller that controls the electric motor, wherein the controller controls the electric motor when performing at least one of fork raising/lowering based on the manipulation of the raising/lowering instruction member and forward or rearward mast tilting based on the manipulation of the tilting instruction member, wherein, when performing the lowering of the fork, in order to obtain a flow rate of hydraulic fluid flowing from the lift cylinder corresponding to a target rotation speed of the hydraulic pump necessary to lower the fork at an instructed speed, the flow control valve controls a flow rate of the hydraulic fluid flowing from the lift cylinder to the hydraulic pump and a flow rate of the hydraulic fluid flowing from the lift cylinder to a draining portion in correspondence with a difference between the target rotation speed of the hydraulic pump necessary to lower the fork at the instructed speed corresponding to a manipulation amount of the raising/lowering instruction member and an actual rotation speed of the hydraulic pump.

* * * * *